United States Patent [19]

Rockerath et al.

[11] 4,102,283

[45] Jul. 25, 1978

[54] SKIPPED STITCH DETECTOR FOR CHAIN STITCH SEWING MACHINES

[75] Inventors: John L. Rockerath, Utica; John H. Blum, Cold Brook, both of N.Y.

[73] Assignee: Cluett, Peabody & Co., Inc., New York, N.Y.

[21] Appl. No.: 737,920

[22] Filed: Nov. 1, 1976

[51] Int. Cl.[2] ..... D05B 51/00

[52] U.S. Cl. ..... 112/131; 112/121.25; 200/61.18

[58] Field of Search ..... 112/218 R, 219 R, 219 A, 112/131, 121.11, 121.25; 200/61.18

[56] References Cited

U.S. PATENT DOCUMENTS

| | | | |
|---|---|---|---|
| 2,674,214 | 4/1954 | Schwartz | 112/219 R |
| 3,425,375 | 2/1969 | Jacobs et al. | 112/218 R |
| 3,587,497 | 6/1971 | Beazley | 112/218 R |
| 3,611,961 | 10/1971 | Lopez et al. | 112/121.11 |
| 3,785,308 | 1/1974 | Brandriff et al. | 112/218 R |
| 3,891,812 | 6/1975 | Marforio | 112/218 R |

*Primary Examiner*—George H. Krizmanich

[57] ABSTRACT

The disclosure is directed to a method and means for detecting a skipped stitch, in the absence of a thread break, on a chain stitch sewing machine or the like. The detector system includes a secondary thread tension system which functions to provide lateral pressure against an unbroken thread in the region between the primary thread tension means and the sewing needle. Whenever, during the course of the sewing operation, there occurs a momentary malfunction in the chain stitch operation, a momentary variation in tension in the unbroken thread occurs in the region between the needle and the primary tension device. This momentary reduction in tension enables a yieldable member to momentarily displace or deflect the thread. The sensing device detects such momentary deflection of the thread and initiates an appropriate control function. A particularly advantageous such control function is the marking of the fabric in the area of the skipped stitch so that the defect may be easily observed and repaired in a subsequent inspection operation. Appropriate for this purpose is the use of one-shot pulse control, in conjunction with an extendable marking device. When a momentary loss of tension is detected, the marking device is momentarily actuated to imprint a mark on the fabric which can be easily detected later on by an inspector.

7 Claims, 3 Drawing Figures

FIG. 1
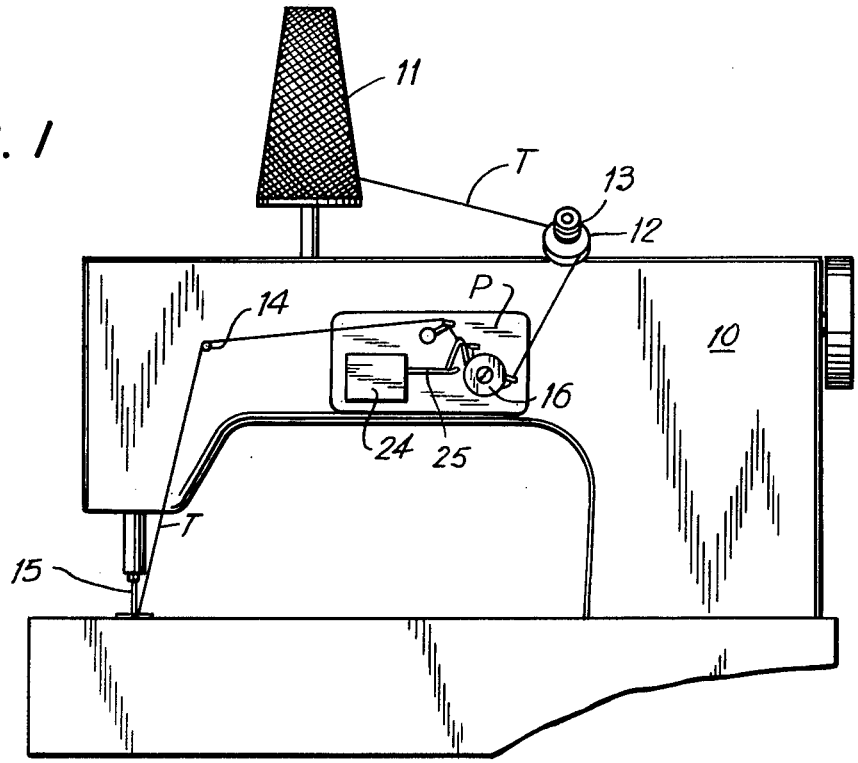
FIG. 2
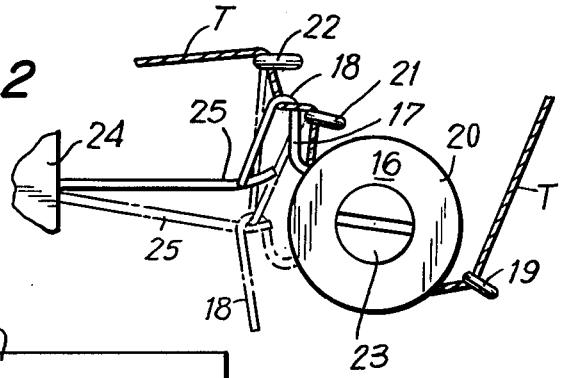
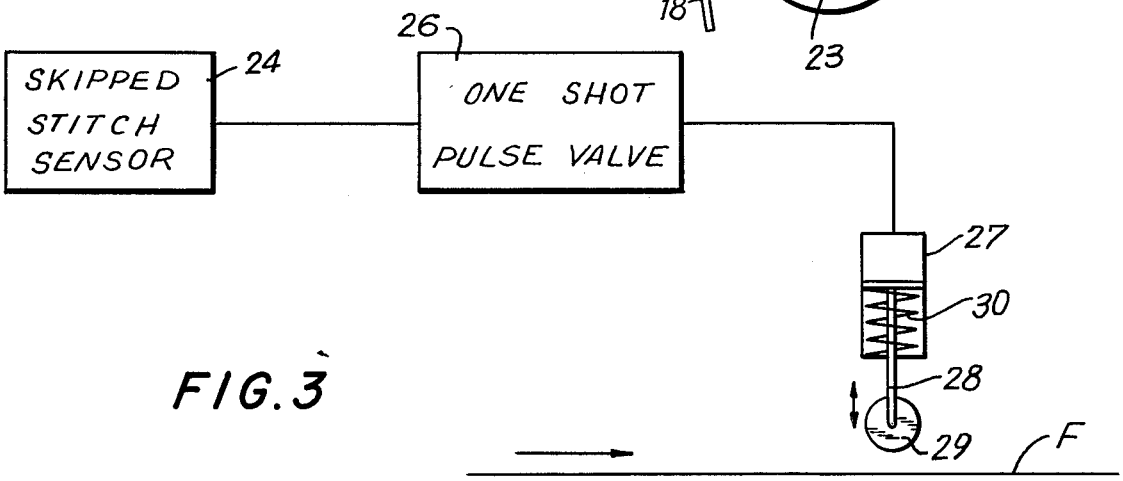
FIG. 3

SKIPPED STITCH DETECTOR FOR CHAIN STITCH SEWING MACHINES

BACKGROUND AND SUMMARY OF THE INVENTION

In the operation of chain stitch type sewing machines thread from a single supply is projected by the sewing needle through the fabric or other material being sewed in the form of a small loop. A looper mechanism, underneath the material to be sewn, engages the loop projected by the needle, not only retaining the loop while the needle is retracted but also displacing the loop relative to the fabric, in the direction of sewing, so that the next loop projected through the fabric by the needle passes though the loop previously formed. In this manner, the successive chain of stitches is formed using a single, continuous thread.

Although chain stitching is fast and economical, one of the weaknesses of the chain stitching system is that an interruption anywhere in the chain can permit the entire series of stitching to be pulled out. Under high speed sewing conditions, most equipment will from time to time momentarily malfunction, such that a stitch loop may not properly engage with the loop formed by the preceding stitch. In such cases, the sewing equipment will simply continue through its normal sequence of operations, commencing a new series of stitches following the skipped stitch. The machine operator, typically, will be entirely unaware that a stitch has been skipped, and the skip is not readily evident in the fabric itself, except by a painstaking, stitch-by-stitch inspection, which of course is highly impracticable. Accordingly, the fabric segment with the undetected skipped stitch in it typically continues to go through its normal production sequence, in which it is incorporated into a finished product. Because of the friction present in the fabric itself, the weakened chain of stitching may hold for a considerable period of time, sufficient to enable the defective part to go through the entire production sequence and have considerable value added thereto and associated therewith. For example, the fabric having a defective sequence of chain stitching may become part of the upholstery of an automobile or an expensive piece of furniture. During service, the defective stitching will prematurely give away and unravel resulting in a possibly defective auto or article of furniture. Thus, by reason of the lack of detection of a single skipped stitch, a manufacturer may be exposed to a substantial expense involved in the replacement or repair of a much larger article.

Although a variety of detectors are available for sensing and actual breakage in a thread, a skipped stitch does not involve a break in the thread, bur merely a failure from time to time for the stitched loop to be picked up and properly engaged by the next successive loop. This may involve only a single stitch, after which the sewing sequence returns to normal.

In accordance with the present invention, a novel and advantageous arrangement is provided for sensing the fact that a single stitch has been skipped in a sewing sequence and executing a control operation response thereto. Particularly, a standard chain stitch type sewing machine is modified by providing, between the primary thread tension control device and the sewing needle, a yieldable element which bears on the thread and displaces the thread as a function of the tension therein. If a stitch is skipped, the typical result is a slight withdrawal of the thread with the retracting needle, instead of the usual holding or pulling down on the thread by the looper mechanism. Accordingly, the tension in the thread, which is otherwise rather constant, is momentarily reduced. This permits the yieldable element bearing on the thread to displace it slightly, and this in turn is detected by a suitable sensing device.

Most advantageously, the sensing device does not stop the sewing machine, but rather actuates a marking device which simply places a high visability marking on the fabric seam in the area of the defect. This can be readily observed later on during an inspection stage and the defect easily repaired. The marking device may be in the form of a one-shot pulse valve, actuated by the sensing device to provide a single actuating pulse such as a pulse of air under pressure. This may serve to actuate a cylinder-mounted inker for example, which descends onto the fabric and places an appropriate mark thereon.

In accordance with one of the more specific aspects of the invention, the yieldable element of the sensing device may advantageously comprise the torsion spring element of a conventional thread tensioning device, as used more typically in bobbin or lock-stitch sewing machines. In the case of the present invention, the last mentioned thread tensioning device, herein referred to as a secondary thread tension device, is not relied upon to establish the thread tension of the chain stitch equipment but serves primarily as a convenient and economical means to provide a yieldable element acting on the thread and responsive to its tension. A sensing device, such as a sensitive microswitch, for example, is positioned to sense the position of the torsion spring element of the secondary tension device. When there is a momentary loss of thread tension, resulting from a skipped stitch, the torsion spring momentarily deflects, and its movement is sensed to execute the desired control function.

For a more complete understanding of the invention, reference should be made to the following detailed description of a preferred embodiment, and to the accompanying drawing.

DESCRIPTION OF THE DRAWING

FIG. 1 is an elevational view of a standard chain stitch type sewing machine incorporating the skipped stitch detector system of the invention.

FIG. 2 is an enlarged, fragmentary view illustrating the use of a secondary thread tension device on the sewing machine of FIG. 1, in conjunction with a sensing switch or the like for detecting momentary loss of thread tension.

FIG. 3 is a simplified, schematic representation illustrating a preferred control function arranged to be executed by the skipped stitch sensing system of FIGS. 1 and 2.

DESCRIPTION OF A PREFERRED EMBODIMENT OF THE INVENTION

Referring now to drawings, the reference numeral 10 designates in a general way a conventional chain stitch type sewing machine. The illustrated machine is a single needle machine, but it will be understood that the principles of the invention are applicable to multiple needle machines as well. By way of the example and not of limitation, the sewing machine 10 may typically be one of the series of 300 W's chain stitch machines marketed by Singer Industrial Products. U.S. Pat. No. 3,628,481 is also illustrative of a typical chain stitch machine, and reference may be had to this disclosure for further details of such machines.

In a standard, conventional chain stitch machine there is a single thread supply 11 per needle and a chain stitch is formed without the use of a bobbin thread supply. Typically, the thread T is directed for a supply cone 11 to a thread tension device 12. The tension control may be a simple friction plate device, comprising a pair of a disc-like plates urged together by a spring 13 under a controlled, adjustable pressure. From the tension device 12, the thread customarily is directed through suitable thread guide elements, such as indicated at 14, and thence to the sewing needle 15. The specific routing of the thread T will, of course, vary from machine to machine and is not significant to the present invention.

When a chain stitch sewing machine is in normal operation, a loop of the thread T is projected downward through the material by the needle 15. This loop is picked up beneath the sewing plane by a so-called looper element (not shown) which holds the loop while the needle is withdrawn. The fabric or other material being sewn is then advanced a distance corresponding to one stitch length, after which the needle 15 descends with a new loop from above. The new loop is passed through the preceding loop, which is being held in the proper position for that purpose by the looper device. The looper then releases the previous loop and engages the new loop, and the cycle is repeated.

The chain stitch sewing technique is widely used because of its many inherent advantages. One of its limitations, however, is that the integrity of the entire stitched seam depends upon the unfailing dependability of the stitch formation. If a single stitch is not properly formed, the entire line of stitching can disintegrate. Frequently, moreover, the friction of the thread on the sewn material will temporarily maintain the integrity of the entire sewn seam while other production operations are performed and considerable value is added to the end product. When the seam later pulls out, it can result in significant cost involvement in the replacement of a finished product of which the sewn materials may only be a fractional part. Experience indicates that defective stitch loops—so-called skipped stitches—will occur from time to time in a continuous production sewing operation, even under carefully controlled conditions. Unlike cases of threadbreaks, for example, a single skipped stitch may occur in a sewing sequence without any noticeable event for the machine operator to observe. Likewise, since the stitches are so small and so numerous. visual inspection of the finished product is not a practicable means of detecting an occasional skipped stitch.

Pursuant to the present invention, a novel and advantageous, dependable and yet highly simplified and economical device is added to the otherwise standard chain stitch type sewing machine to enable a skipped stitch to be reliably sensed as it occurs. By enabling evan a single skipped stitch to be effectively and dependably sensed, it is possible to execute appropriate control functions in response to the existence of a skipped stitch in a continuous sewing sequence. Although one possible control function would be to stop the machine to enable an immediate repair to be performed, a more advantageous control function for many production operations is the performance of a marking operation, placing an easily visible mark on the seam in the area of the skipped stitch, so that the defective area may be readily spotted latter on by visual inspection and repaired at another location. The latter technique is particularly suited for high speed, continuous production operations, in which sewing machines may not be individually attended by workers and/or where stoppage of the sewing machine could interrupt the continuity of production line.

In a most advantageous form of the invention, the sensing system includes a secondary thread tension device, generally designated by the numeral 16, which is located between the primary thread tension device 12 and the thread guide 14 leading to the needle 15. The secondary thread tension device 16 may be of a conventional, commercially available form, as generally found on bobbin type sewing machines, and includes a low mass but highly responsive torsion spring element 17 provided with a thread hook 18 thereon. One such type device is illustrated in, for example, U.S. Pat. No. 3,738,298, the disclosure of which may be considered as incorporated herein by reference and which may b referred to for details of the construction of suitable thread tension device.

Referring particularly to FIG. 2, the secondary thread tension device 16 typically may include a secondary thread guide 19 on the upstream side of a pair of opposed friction discs 20, and additional secondary thread guides 21 and 22 on the downstream side of the friction discs. The thread T is guided from the primary tension device 12 through the first guide 19, between the discs 20, out through the additional secondary guides 21 and 22 and over to the primary thread guide 14. In the short span of thread between the secondary guides 21, 22, the hook portion 18 of the torsion spring 17 engages the thread and tends yieldably to displace the thread in the return direction of the torsion spring, which is in a counter-clockwise direction in the illustrated arrangement.

As a conventional device, the secondary thread tension unit 16 will include a compression spring (not shown), adjustable by a suitable screw 23 or the like, to control the pressure on the opposed clamping plates 20, through which the thread T is guided as it passes between the secondary guide 19, 21. Typically, little if any pressure is imparted to the thread by the plates 20, as the primary thread tensioning device 12 is relied upon to control thread tension to the needle 15. Primarily, the secondary thread tension device is utilized to derive the yieldable displacement function of its torsion spring 17. In principle, it might be possible to eliminate entirely utilization of the friction aspects of the secondary thread tension device 16 and utilize only the function of the torsion spring 17. Likewise, it would be possible in principle to simply employ a suitable yieldable device acting to displace the thread between appropriate thread guide elements. As a practical matter, however, a standard conventional tension device, of the type typically found on conventional bobbin-type lock stitch sewing machines is ideally suited for the purposes of the present invention, and it is readily available on an economically attractive basis. Accordingly the secondary thread tension device is in many ways an ideal device for the purposes of the present invention.

In the continuous operation of a chain stitch sewing machine of the type described, the continuous co-action of the looper device and the sewing needle is such that there is relatively little moment-to-moment variation in the tension of the thread T on the downstream side of the thread tension device 12 during normal sewing operations. However, if a skipped stitch condition occurs for even a single stitch, there is a momentary failure of the mechanism to retain the thread as the needle is withdrawn, and this is reflected in a momentary reduction of tension in the thread between the needle and the primary thread tension device. Bearing in mind that the sewing machine may be operated at a speed of several thousand stitches per minute, the thread tension loss in the skipping of a single stitch would be virtually imperceptible to even the most attentive machine operator and would go unnoticed under normal circumstances. However, with the system of the present invention, the torsion spring 17, which is an extremely light weight, low inertia element, reacts instantly to the loss of thread tension by moving in a counterclockwise direction carrying with it a section of the thread in the span between the secondary thread guides 21, 22. By way of illustration, in FIG. 2, the hooked torsion spring 17 is shown in full lines in its normal, yieldably displaced position, in which it is held by a thread T under normal sewing tension. When there is a momentary loss of tension due to a skipped stitch, the torsion spring 17 will rotate in a counterclockwise direction to a position as shown in broken lines in FIG. 2, drawing downward on the span of thread. With the next successive stitch, assuming that the sewing machine resumes functioning properly, the normal tension is resumed and the torsion spring 17 is returned to its normal, full lines position as illustrated in FIG. 2.

Pursuant to the invention, there is provided in conjunction with the moveable torsion spring 17 a suitably responsive sensing device 24, which is capable of sensing and responding to the momentary movement of the torsion spring. In one practical form of the invention, the sensing device 24 may be a highly sensitive microswitch unit, with an elongated actuating finger 25. The switch 24, along with the secondary thread tension device 16 and the secondary thread guides 19, 21 and 22, may advantageously be secured to a common mounting plate P adjacent to the secondary thread tension device, and the actuating finger 25 is arranged to extend into the bight of the spring hook 18. The arrangement is such that when the spring moves momentarily in response to the instaneous loss of thread tension, the actuating finger 25 is engaged by the torsion spring and displaced slightly, sufficiently to actuate the switch 24, and commence a control function.

It will be appreciated, of course, that any of a variety of means, including photoelectric devices, fluidic elements, electric contact devices or the like may be utilized to sense the momentary displacement of the torsion spring 17, the requirement of the sensing device being the ability to dependably respond to the displacement of a low mass torsion spring element under very light torsional forces. Under some circumstances, actuation of the sensing device 24 can be utilized to stop the operation of the sewing machine and sound an alarm for the machine attendant. More advantageously, the system of the invention may include a marking system, which functions to place a readily visible mark on the defective area of the seam, for repair in another production stage, while enabling the production operation to continue. In this respect, in a continuous series of chain stitches, an occasional skipped stitch typically will not render the entire series of stitches obviously defective until the article has been subjected to some usage. In other words, the stitching both upstream and downstream from the defect will be useful, provided the defect is repaired before the seam begins to unravel. Typically, this will not occur immediately, and it is often convenient and entirely effective to simply mark the defect, continue to handle the product through the production operation, and thereafter, take the product to an inspection and repair department. Upon repair of the immediate area of the defect, the entire sewn product is once again intact and within specifications.

In accordance with one aspect of the invention, the output device 24 of the sensing system is arranged to actuate a one shot pulse valve 26. The output of the pulse valve is connected to a spring-returned air actuator device 27, the extendable operating rod 28 which carries a marking wheel or the like 29. The marking device 29 may, in itself, be of a wholly conventional type. In the arrangement illustrated in FIG. 3, when the switch 24 or other sensor is momentarily actuated, the pulsing valve is operated to deliver a pulse of air to the cylinder 27, ths projects the marking wheel 29 down onto the surface of the fabric F, making a visible imprint thereon. The pulse valve 26 serves to provide a momentary actuation for cylinder 27, and it immediately returns to its retracted position, by means of a spring 30.

The new skipped stitch detecting system, notwithstanding its basic simplicity and the ease and economy with which it may be installed on a standard chain stitch machine, represents a truly enormous improvement in the production operation of such machines, since it enables the loss of even a single stitch to be detected and repaired before the defectively sewn article becomes incorporated in a more comprehensive finished product.

In its broadest concepts, the skipped stitch detector device of the present invention utilizes a yieldable element, acting upon the tensioned thread, between the primary tension device and one of the thread guides on the downstream side of the tension device. Movement of this yieldable element, in response to momentary reduction of tension in the thread beyond expected minor fluctuations, can be easily and dependably sensed. However, a most convenient and economical manner of providing such a yieldable element is by installing on the machine a complete thread tension unit of the type typically utilized in a lockstitch type machine where wide momentary fluctuations in thread motion are sought to be accommodated by provision of a highly responsive, low inertia torsion spring device acting on the thread. Such a device is ideally suited for the purposes of the present invention and is of course, readily available on an economical basis.

The system of the invention provides a dependable and reliably effective skipped stitch detecting system for a chain stitch sewing machine, such that the chain stitching technique is rendered far more reliable and effective than heretofore. By way of example only, the chain stitching technique is widely utilized in the production of automobile upholstery panels. If a single stitch is skipped in a given seam, it is likely to develop into a visible defect sometime after completion of the automobile and its delivery to a customer. In such cases, repair of the defect involves far more than simple repair of the stitching. It may involve recall and partial disassembly of a finished automobile, resulting in an inordinate expense both in terms of labor involvement and loss of customer good will. With the system of the present invention, any such defect is easily detectable and correctable at an early production stage, before significant value is either added to or associated with the component part.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A skipped stitch detector system for a chain stitch type sewing machine of the type including
(a) a thread supply,
(b) a thread tension control device,
(c) a reciprocating sewing needle,
(d) thread guide means between said thread tension control device and said needle, said detector system comprising,
(e) low mass, yieldably displaceable means engaging the thread between said thread guide means and said tension control device and urging said thread out of its normal, guided path, as a function of the momentary tension in said thread,
(f) said displaceable means being cyclically displaceable through a limited distance during normal sewing and being displaceable through a further distance in response to momentary abnormal loss of tension in said thread, and
(g) sensor means positioned in the path of said yieldably displaceable means responsive to an abnormally displaced position of said yieldably displaceable means for executing a control function.

2. A skipped stitch detector according to claim 1, further characterized by
(a) a secondary thread tension device comprising resiliently pressed friction means and an associated torsion spring,
(b) said torsion spring constituting said low mass yieldably displaceable means.

3. A skipped stitch detector according to claim 2, further characterized by
(a) a pair of secondary thread guides located adjacent said secondary thread tension device,
(b) said secondary thread guides being spaced relatively close together and defining a relatively short guide span for said thread on the downstream side of said secondary thread tension device,
(c) said torsion spring engaging said thread in said guide span and being operative to displace said thread substantially out of said span in response to a momentary reduction of tension in an unbroken thread.

4. A skipped stitch detector according to claim 3, further characterized by
(a) said sensor means including a member engageable by said torsion spring.

5. A skipped stitch detector system for a chain stitch type sewing machine of the type including,
(a) a thread supply,
(b) a thread tension control device, and
(c) a reciprocating sewing needle, said detector system comprising,
(d) means on the downstream side of said thread tension device forming a guide path for the thread,
(e) a low mass yieldable member bearing on the thread in said guide path and tending to displace the thread laterally as a function of thread tension,
(f) sensing means co-acting with said yieldable member to sense a momentary displacement of the thread resulting from momentary relaxation of thread tension, and
(g) means for marking the material being sewn in the region of a skipped stitch, in response to actuation of said sensing means,
(h) said means for marking the fabric including a one-shot pulse valve and an air-activated support,
(i) said air-activated support being connected to said pulse valve whereby, upon momentary activation of said valve, said support is extended and retracted, to effect limited marking of the material.

6. In combination with a chain stitch type sewing machine having a needle and a thread supply and thread tension means located between said needle and supply,
(a) yieldably displaceable means for continuously sensing the condition of the thread between said needle and said tension means, and
(b) control means associated with said yieldably displaceable means operative in response to a momentary loss and restoration of normal condition of an intact thread for executing a skipped stitch control function,
(c) said yieldably displaceable member having a normal range of displacement during normal sewing operations,
(d) said control means including a sensing member for sensing abnormal displacement of said displaceable member.

7. The combination of claim 6, further characterized by
(a) marking means being provided for marking the material being sewn, and
(b) said skipped stitch control function comprising the activation of said marking means.

* * * * *